US007592978B2

(12) United States Patent
Kim

(10) Patent No.: US 7,592,978 B2
(45) Date of Patent: Sep. 22, 2009

(54) PLASMA DISPLAY PANEL DRIVING METHOD

(75) Inventor: Joon-Yeon Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 737 days.

(21) Appl. No.: 10/998,449

(22) Filed: Nov. 29, 2004

(65) Prior Publication Data

US 2005/0116897 A1 Jun. 2, 2005

(30) Foreign Application Priority Data

Nov. 29, 2003 (KR) ..... 10-2003-0086096

(51) Int. Cl.
*G09G 3/28* (2006.01)

(52) U.S. Cl. ..... 345/67

(58) Field of Classification Search ..... 345/60–72; 315/169.4

See application file for complete search history.

(56) References Cited

U.S. PATENT DOCUMENTS

| | | | | |
|---|---|---|---|---|
| 6,195,073 | B1 * | 2/2001 | Lin | 345/67 |
| 6,414,656 | B1 * | 7/2002 | Hong | 345/60 |
| 6,504,519 | B1 * | 1/2003 | Ryu et al. | 345/60 |
| 6,512,500 | B2 * | 1/2003 | Sasaki et al. | 345/60 |
| 6,795,044 | B2 * | 9/2004 | Tanaka et al. | 345/67 |
| 6,833,824 | B2 * | 12/2004 | Ide et al. | 345/60 |
| 2003/0132898 | A1 | 7/2003 | Akiba | |

FOREIGN PATENT DOCUMENTS

| | | | |
|---|---|---|---|
| CN | 1417832 | A | 5/2003 |
| CN | 1424739 | A | 6/2003 |
| EP | 1174851 | A2 * | 1/2002 |
| EP | 1 316 937 | A2 | 6/2003 |

* cited by examiner

*Primary Examiner*—Chanh Nguyen
*Assistant Examiner*—Adam J Snyder
(74) *Attorney, Agent, or Firm*—Christie Parker & Hale LLP

(57) ABSTRACT

A method for driving a plasma display panel (PDP) and for safely erasing wall charges in an erase period. The PDP includes a middle (M) electrode formed between an X electrode and a Y electrode. A sustain discharge pulse voltage is periodically applied to the X electrode and the Y electrode in a pulse train fashion. In addition, a reset waveform, a scan pulse voltage, and a sustain discharge voltage are applied to the middle electrode. Moreover, to prevent a strong discharge, an erase waveform is applied to the M electrode in the erase period while the X and Y electrodes are biased with the same voltage level. Alternatively, to prevent a strong discharge, an erase waveform (a gradually rising waveform) is applied to the X electrode in the erase period while the M and Y electrodes are biased with the same voltage level (a ground voltage).

3 Claims, 8 Drawing Sheets

PLASMA DISPLAY PANEL DRIVING METHOD

CROSS REFERENCE TO RELATED APPLICATION

This application claims priority to and the benefit of Korea Patent Application No. 10-2003-0086096 filed on Nov. 29, 2003 in the Korean Intellectual Property Office, the entire content of which is incorporated herein by reference.

BACKGROUND OF THE INVENTION (a) Field of the Invention

The present invention relates to a plasma display panel (PDP) driving method.

(b) Description of the Related Art

Recently, liquid crystal displays (LCDs), field emission displays (FEDs), and plasma displays have been actively developed. Among the flat panel devices, the plasma displays have better luminance and light emission efficiency as compared to the other types of flat panel devices, and also have wider view angles. Therefore, the plasma displays have come into the spotlight as substitutes for the conventional cathode ray tubes (CRTs) in large displays of greater than 40 inches.

The plasma display is a flat display that uses plasma generated via a gas discharge process to display characters or images. Depending on its size, the plasma display can include tens to millions of pixels that are provided thereon in a matrix format. According to supplied driving voltage waveforms and discharge cell structures, plasma displays can be categorized into direct current (DC) plasma displays and alternating current (AC) plasma displays.

Since the DC plasma displays have electrodes exposed in the discharge space without insulation, they allow a current to flow in the discharge space while the voltage is supplied, and therefore they are problematic in that they require resistors for current restriction. On the other hand, since the AC plasma displays have electrodes covered by a dielectric layer, capacitances are naturally formed to restrict the current, and the electrodes are protected from ion shocks in the case of discharging. Accordingly, the AC plasma displays have a longer lifespan than the DC plasma displays.

FIG. 1 shows a partial perspective view of an AC PDP, and FIG. 2 shows a cross-sectional view of the PDP shown in FIG. 1.

As shown in FIGS. 1 and 2, X electrode 3 and Y electrode 4, made of transparent conductive matter and disposed over dielectric layer 14 and protection film 15, are provided in parallel and form a pair with each other under first glass substrate 11. Metallic bus electrodes 6 are respectively formed on the surfaces of X and Y electrodes 3 and 4.

A plurality of address electrodes 5 covered with dielectric layer 14' are installed on second glass substrate 12. Barrier ribs 17 are formed on dielectric layer 14' between address electrodes 5, and in parallel with address electrodes 5. Phosphors 18 are formed on the surface of dielectric layer 14' between barrier ribs 17. First and second glass substrates 11, 12 are provided facing each other with discharge space 19 between first and second glass substrates 11, 12 so that Y electrode 4 and the X electrode 3 may respectively cross address electrodes 5. An address electrode of the address electrode 5 and discharge space 19 formed at a crossing part of Y electrode 4 and X electrode 3 form schematically indicated discharge cell 20.

FIG. 3 shows a conventional PDP electrode arrangement diagram. The conventional PDP electrodes have an m×n matrix configuration. Address electrodes $A_1$ to $A_m$ are arranged in a column direction, and Y electrodes $Y_1$ to $Y_n$ and X electrodes $X_1$ to $X_n$ are alternately arranged in a row direction. Discharge cell 20 shown in FIG. 3 substantially corresponds to discharge cell 20 shown in FIG. 1.

FIG. 4 shows a conventional PDP driving waveform diagram. In a conventional PDP, one frame is divided into a plurality of subfields that are combined to express a gray scale. Each subfield according to the conventional PDP method shown in FIG. 4 includes a reset period, an address period, and a sustain period. The reset period erases wall charges formed during a previous sustain discharge, and sets up new wall charges in order to stably perform functions in a next address period. In the addressing period, the cells that are turned on and the cells that are not turned on in a panel are selected, and wall charges are accumulated on the cells that are turned on (i.e., the addressed cells). In the sustain period, discharge for actually displaying pictures on the addressed cells is performed by alternately applying a sustain discharge voltage to the X and Y electrodes.

Operations of the conventional reset period of the conventional PDP driving method will now be described in more detail. As shown in FIG. 4, the reset period includes an erase period (I), a Y ramp rising period (II), and a Y ramp falling period (III).

(1) Erase Period (I)

While the X electrode is biased with a constant potential of Vbias, a falling ramp which slowly falls from a sustain discharge voltage of Vs to a ground potential (or 0V) is applied to the Y electrode, and the wall charges formed in the sustain period are eliminated.

(2) Y Ramp Rising Period (II)

During this period, the address electrode (not shown) and the X electrode are maintained at 0V, and a ramp voltage gradually rising from the voltage of Vs to the voltage of Vset is applied to the Y electrode. While the ramp voltage rises, a weak reset discharge is generated on all the discharge cells from the Y electrode to the address electrode and the X electrode. As a result, the (−) wall charges are accumulated on the Y electrode, and concurrently, the (+) wall charges are accumulated on the address electrode and the X electrode.

(3) Y Ramp Falling Period (III)

In the latter part of the reset period, a ramp voltage that gradually falls from the voltage of Vs to the 0V is applied to the Y electrode under the state that the X electrode maintains the constant voltage of Vbias. While the ramp voltage falls, a weak reset discharge is generated again at all the discharge cells.

In the sustain discharge period, the same sustain discharge voltage Vs is alternately applied to the X and Y electrodes to perform a sustain discharge for displaying actual images on the addressed cells. In this instance, it is desirable to apply symmetric waveforms to the X and Y electrodes during the sustain discharge period.

However, a circuit for driving the Y electrode is different from a circuit for driving the X electrode since a waveform applied to the Y electrode (a waveform for resetting and scanning is additionally applied to the Y electrode) is different from a waveform applied to the X electrode in the reset period of the conventional PDP. Accordingly, the driving circuits of the X and Y electrodes are not impedance-matched, the waveform alternately applied to the X and Y electrodes in the sustain discharge period is distorted, and a bad discharge is generated.

Also, a problematic (or weak) discharge may be generated due to insufficient priming particles generated in the discharge cell when the first (or initial) sustain discharge pulse is applied after the address period in the conventional PDP.

SUMMARY OF THE INVENTION

It is an aspect of the present invention to provide a PDP and a driving method thereof for preventing a bad discharge.

It is another aspect of the present invention to provide a PDP driving method for safely erasing wall charges in an erase period of a reset period.

In one exemplary embodiment of the present invention, a method for driving a PDP is provided. The PDP includes a first electrode and a second electrode to which a sustain discharge pulse is applied respectively, and a third electrode formed between the first and second electrodes. Between a sustain period and a reset period, the method includes: (a) applying a gently falling voltage waveform, which gently falls from a first voltage to a second voltage, to the third electrode; (b) applying a third voltage, which is greater than the second voltage, to the first electrode while the gently falling voltage waveform is applied; and (c) applying a fourth voltage, which is greater than the second voltage to the second electrode, while the gently falling voltage waveform is applied.

In one exemplary embodiment of the present invention, a method for driving a PDP is provided. The PDP includes a first electrode and a second electrode to which a sustain discharge pulse is applied respectively, and a third electrode formed between the first and second electrodes. Between a sustain period and a reset period, the method includes: (a) applying a gently rising voltage waveform, which gently rises from a first voltage to a second voltage, to the first electrode; (b) applying a third voltage, which is less than the second voltage, to the second electrode while the gently rising voltage waveform is applied; and (c) applying a fourth voltage, which is less than the second voltage, to the third electrode while the gently rising voltage waveform is applied.

In one embodiment of the present invention, a method for driving a PDP is provided. The PDP includes a first electrode and a second electrode to which a sustain discharge pulse is applied respectively, and a third electrode formed between the first and second electrodes. Between a sustain period and a reset period, the method includes: (a) applying a narrow pulse voltage waveform comprising a first voltage and a second voltage to the third electrode; (b) applying a third voltage, which is not less than the first voltage and also not less than the second voltage, to the first electrode while the narrow pulse voltage waveform is applied; (c) applying a first pulse width of the third voltage, which is greater than a narrow pulse width of the first voltage applied to the third voltage, to the first electrode while the narrow pulse voltage waveform is applied; (d) applying a fourth voltage, which is not less than the first voltage and also not less than the second voltage, to the second electrode while the narrow pulse voltage waveform is applied; and (e) applying a second pulse width of the fourth voltage, which is greater than the narrow pulse width of the first voltage, to the second electrode while the narrow pulse voltage waveform is applied.

In one exemplary embodiment of the present invention, a method for driving a PDP is provided. The PDP includes a first electrode and a second electrode to which a sustain discharge pulse is applied respectively, and a third electrode formed between the first and second electrodes. After a sustain period, the method includes: applying an erase waveform to at least one of the first electrode, the second electrode, and the third electrode, and erasing wall charges formed on the first and third electrodes or wall charges formed on the second and third electrodes.

In one exemplary embodiment of the present invention, a method for driving a PDP is provided. The PDP includes a first electrode and a second electrode to which a sustain discharge pulse is applied respectively, and a third electrode formed between the first and second electrodes. Between a sustain period and a reset period, the method includes: (a) applying an erase waveform, which is temporally varied from a first voltage to a second voltage, to at least one of the first electrode, the second electrode, and the third electrode; and (b) applying a bias voltage to the electrodes other than the electrode to which the erase waveform is applied, wherein a difference between the second voltage and the bias voltage is greater than a difference between the first voltage and the bias voltage.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

In the following detailed description, only certain exemplary embodiments of the present invention are shown and described, simply by way of illustration. As those skilled in the art would realize, the described exemplary embodiments may be modified in various different ways, all without departing from the spirit or scope of the present invention. Accordingly, the drawings and description are to be regarded as illustrative in nature, and not restrictive.

Figure 1:
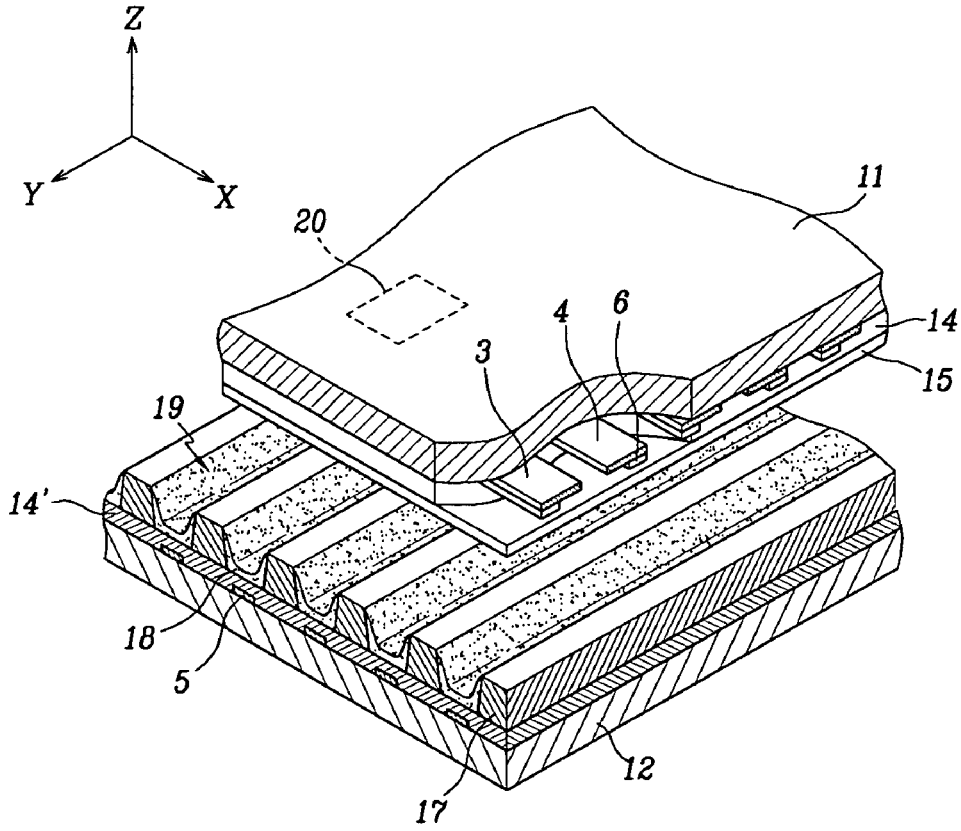
FIG. 1 (Prior Art)
FIG. 1 shows a conventional perspective view of an AC PDP.
Figure 2:
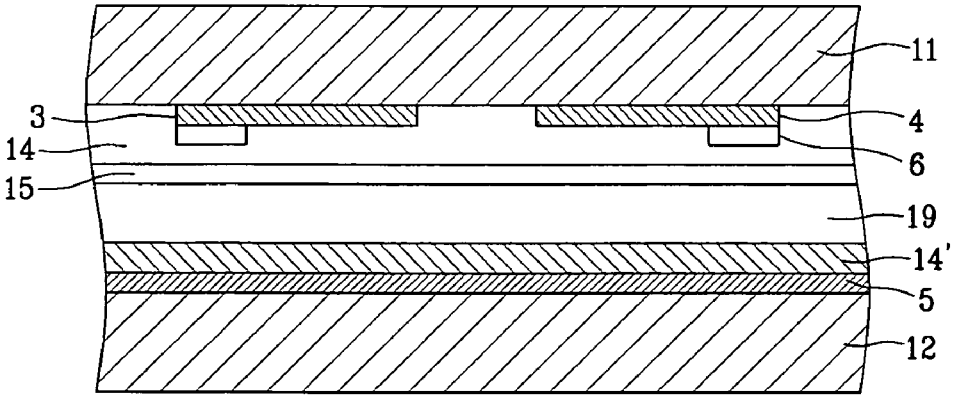
FIG. 2 (Prior Art)
FIG. 2 shows a cross-sectional view of the PDP shown in FIG. 1.
Figure 3:
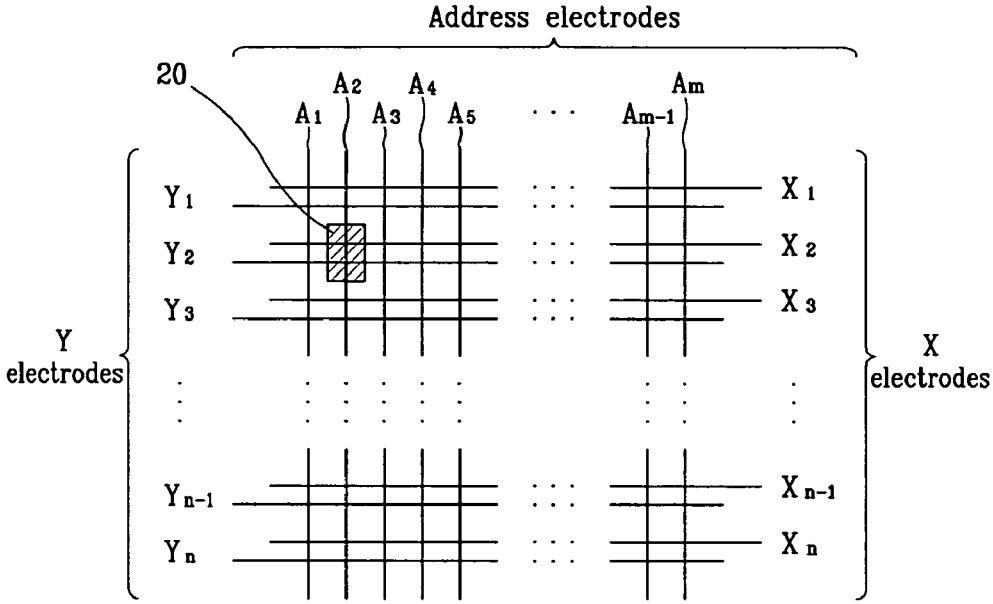
FIG.3(Prior Art)
FIG. 3 shows a conventional PDP electrode arrangement diagram.
Figure 4:
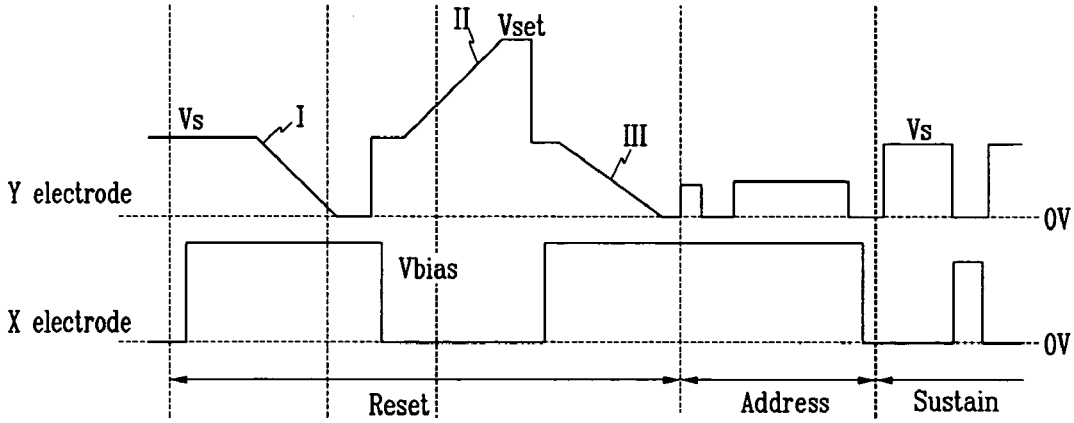
FIG.4(Prior Art)
FIG. 4 shows a conventional PDP driving waveform diagram.
Figure 5:
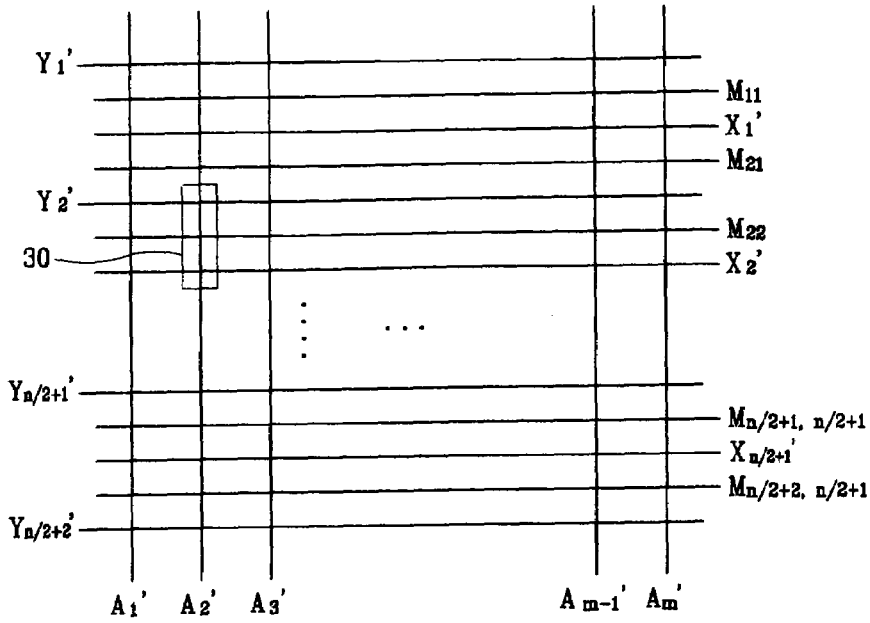
FIG. 5 shows a PDP electrode arrangement diagram according to certain exemplary embodiments of the present invention.

As shown in FIG. 5, a PDP includes address electrodes Al' to Am' arranged in parallel in a column direction, Y electrodes $Y_1'$ to $Y_{n/2+2}'$ in n/2+2 rows, X electrodes $X_1'$ to $X_{n/2+1}'$ in n/2+1 rows, and middle electrodes (referred to as M electrodes hereinafter) $M_{11}$, $M_{21}$, $M_{22}$ to $M_{n/2+2,n/2+1}$ in n+2 rows.

That is, the M electrodes are arranged in the middle of the Y and X electrodes. The Y electrode, the X electrode, the M electrode, and the address electrode provide a four-electrode structure to form single discharge cell 30.

The X and Y electrodes function as electrodes for applying sustain discharge voltage waveforms, and the M electrodes function as electrodes for applying a reset waveform and a scan pulse voltage.

Figure 6:
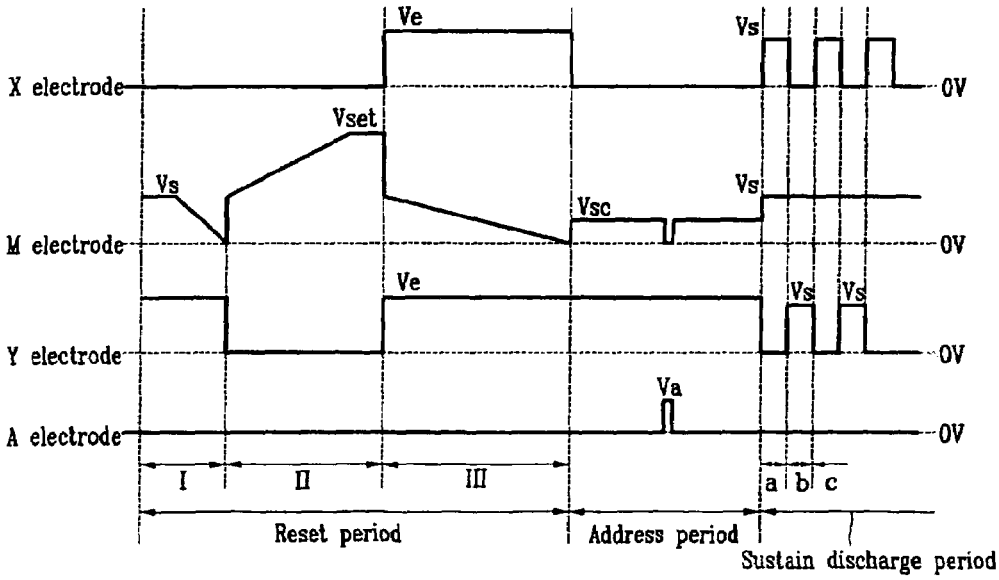
FIG. 6 shows a PDP driving waveform diagram according to a first exemplary embodiment of the present invention.

FIG. 6 shows a PDP driving waveform diagram according to a first exemplary embodiment of the present invention, and FIGS. 7A to 7E show distribution diagrams of wall charges based on the driving waveform shown in FIG. 6.

A driving method according to the first exemplary embodiment will now be described with reference to FIGS. 6, and 7A to 7E.

Each subfield includes a reset period, an address period, and a sustain period according to the driving method shown in FIG. 6.

The reset period includes an erase period (I), an M electrode rising waveform period (II), and an M electrode falling waveform period (III).

(1) Reset Period (1-1) Erase Period (I)

Figure 7A:
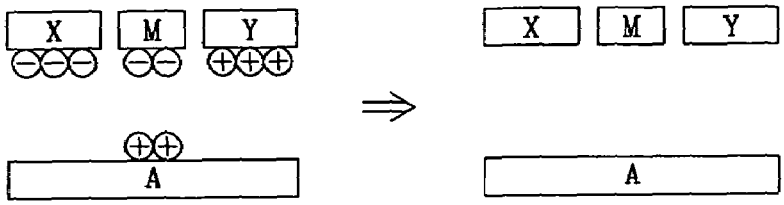
FIGS. 7A to 7E show wall charges distribution diagrams based on the driving waveform according to the first exemplary embodiment of the present invention.

In the erase period, the wall charges formed during a previous sustain discharge period are erased. Assuming that a sustain discharge voltage pulse Vs is applied to the X electrode and a voltage (e.g., a ground voltage) which is lower than the voltage applied to the X electrode is applied to the Y electrode at the last point of the sustain discharge period, (+) wall charges are formed on the Y electrode and the address electrode and (−) wall charges are formed on the X electrode and the M electrode, as shown in FIG. 7A.

In the erase period, a waveform (a ramp waveform or a logarithmic waveform) which gently falls to the ground voltage from the voltage of Vs is applied to the M electrode while the Y electrode is biased with the voltage of Ve and the X electrode and the address electrode are biased with the ground (0V or a voltage which is lower than the voltage of Ve). Because of the waveform(s) and/or voltage(s) applied (e.g., to the M and Y electrodes), the wall charges formed during the sustain discharge period are erased as shown in FIG. 7A. In this instance, the voltage of Vs can correspond to the voltage of Ve, e.g., Vs=Ve, for the purpose of a circuit design, however, the first exemplary embodiment is not restricted to this correspondence (e.g., Vs can be less than Ve).

(1-2) M Electrode Rising Waveform Period (II)

Figure 7B:
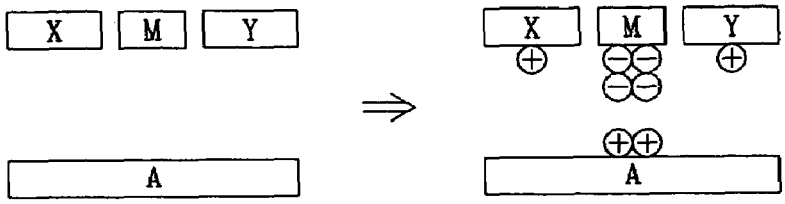

In this period, a waveform (a ramp waveform or a logarithmic waveform) which gently rises to the voltage of Vset from the voltage of Vs is applied to the M electrode while the X and Y electrodes are biased with the ground voltage. At all the discharge cells, a weak reset discharge is generated from the M electrode to the address electrode, the X electrode, and the Y electrode. As a result, the (−) wall charges are accumulated on the M electrode, and the (+) wall charges are accumulated on the address electrode, the X electrode, and the Y electrode as shown in FIG. 7B.

(1-3) M Electrode Falling Waveform Period (III)

In the latter part of the reset period, a waveform (a ramp waveform or a logarithmic waveform) which gently falls to the ground voltage from the voltage of Vs is applied to the M electrode while the X and Y electrodes are biased with the voltage of Ve. A weak reset discharge is generated at all the discharge cells while the ramp voltage falls. In this instance, because the M electrode falling waveform period is a period for slowly reducing the wall charges accumulated during the M electrode rising waveform period, new wall charges can be set up for the next address period (or address discharge) as the time of the falling waveform is increased (i.e., as the gradient becomes gentle) since the reduced amount of wall charges can be precisely controlled.

Figure 7C:
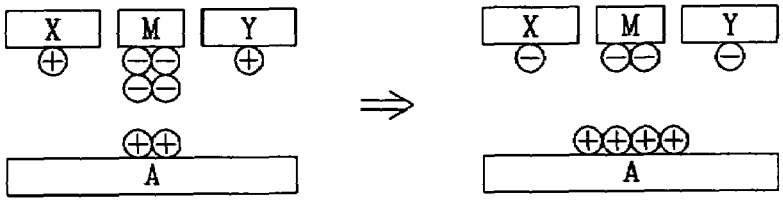

When the falling waveform is applied to the M electrode, the previous wall charges accumulated on the respective electrode of all the cells are equivalently erased, the new (+) wall charges are stored on the address electrode, and the new (−) wall charges are concurrently stored on the X electrode, the Y electrode, and the M electrode, as shown in FIG. 7C.

(2) Address Period (Scan Period)

In the address period, the ground voltage is sequentially applied to the M electrodes to thus apply a scan pulse, and an address voltage is applied to the address electrodes corresponding to the cells to be discharged (i.e., turned-on cells). In this instance, the X electrode is maintained at the ground voltage, and the voltage of Ve is applied to the Y electrode (i.e., the voltage which is higher than the voltage at the X electrode is applied to the Y electrode.)

Figure 7D:
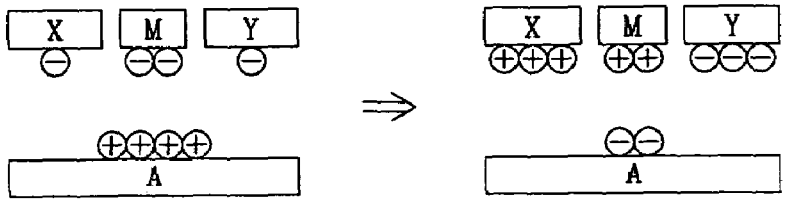

A discharge is generated between the M electrode and the address electrode, a discharge is generated between the X electrode and the Y electrode, and as shown in FIG. 7D, the (+) charges are stored at the X and M electrodes and the (−) wall charges are stored at the Y electrode and the address electrode.

(3) Sustain Discharge Period

In the sustain discharge period, a sustain discharge voltage pulse (having voltage Vs) is alternately applied to the X and Y electrodes (in a pulse train fashion) while the M electrode is biased with the sustain discharge voltage of Vs. As such, a sustain discharge is generated at the discharge cells selected in the address period through the application of the sustain discharge voltage and the sustain discharge voltage pulse.

In this instance, discharges are generated through different discharge mechanisms in the initial sustain discharge stage and the normal stage. For ease of description, the discharge which occurs at the initial part of the sustain discharge period will be referred to as a short-gap discharge period, and the discharge at the time away from the initial part (or at normal time) will be referred to as a long-gap discharge period.

(3-1) Short Gap Discharge Period

Figure 7E:
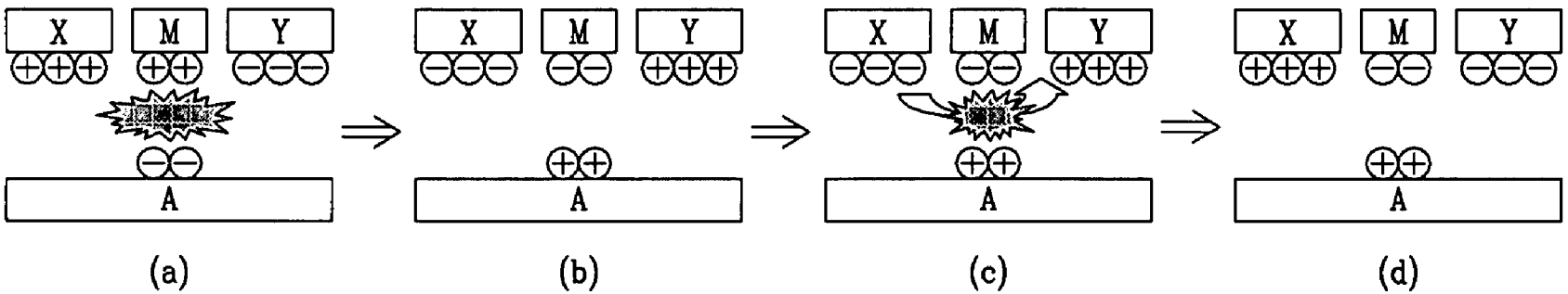

As shown in parts (a) and (b) of FIG. 7E, (+) voltage pulses are applied to the X electrode and (−) voltage pulses are applied to the Y electrode (wherein the signs of (+) and (−) represent relative concepts caused by comparing the magnitude of the voltage applied to the X with the magnitude of the voltage applied to the Y electrode, and applying the (+) pulse voltages to the X electrode represents applying a voltage which is greater than the voltage applied to the Y electrode to the X electrode and the sign of (−) does not necessarily have to be a negative voltage, i.e., a voltage below 0V) in the start period of the sustain discharge. Concurrently, the (+) voltage pulses are applied to the M electrode. Therefore, the discharges between the X electrode/M electrode and the Y electrode are generated, differing from the conventional discharge generated between the X and Y electrodes. In particular, the electrical field applied between the M and Y electrodes becomes greater since the distance between the M and Y electrodes is shorter than the distance between the X and Y electrodes. Therefore, the discharge between the M and Y electrodes performs a more dominant role than the discharge between the X and Y electrodes. Accordingly, the discharge which occurs at the initial part of the sustain discharge is named to be the short-gap discharge since the discharge between the M and Y electrodes with a relatively shorter distance performs the leading role in the earlier part of the sustain discharge.

As described, since the relatively higher electric field is applied at the earlier stage of the sustain discharge to generate a short gap discharge, a sufficient discharge is achieved even if insufficient priming particles may be generated in the discharge cell at the time of applying a first (or initial) sustain discharge pulse after the address period.

(3-2) Long Gap Discharge Period

Since the voltage at the M electrode is biased with a constant voltage of Vs after the first sustain discharge pulse of the sustain discharge is applied (e.g., after (a)), the discharge between the M and X electrodes or the discharge between the M and Y electrodes (i.e., the short gap discharge) has less contribution to the discharge, the discharge between the X and Y electrodes becomes the main discharge, and as a result, the input video is displayed according to the number of discharge pulses alternately applied to the X and Y electrodes.

That is, as shown in parts (c) and (d) of FIG. 7E, the (−) wall charges are consecutively stored on the M electrode, and the (−) and (+) wall charges are alternately stored on the X and Y electrodes during the sustain discharge period in the normal state.

According to the first exemplary embodiment, a sufficient discharge is performed when less priming particles are provided since the discharge is performed by the short gap discharge between the X and M electrodes (or between the Y and M electrodes) in the initial part of the sustain discharge (e.g., during the application of the initial or first discharge pulse), and a stable discharge is performed in the normal state since the discharge is performed according to the long gap discharge between the X and Y electrodes.

Also, since almost symmetric voltage waveforms (or pulse periods or pulse widths) are applied to the X and Y electrodes, substantially similar circuits for driving the X and Y electrodes can be used. Therefore, since most of the difference of the circuit impedance between the X and Y electrodes is eliminated, distortion of the pulse waveforms applied to the X and Y electrodes is reduced to allow the stable discharge during the sustain discharge period.

According to the first exemplary embodiment shown in FIG. 6, a PDP of the present invention is driven when the waveforms of the X and Y electrodes are exchanged (or mirrored), and also when the waveforms of the X and Y electrodes are exchanged (or mirrored) in the address period.

As shown in FIG. 6, the waveform which gently falls to the ground voltage from the voltage of Vs has been applied to the M electrode while the X electrode is grounded and the Y electrode is biased with the voltage of Ve in the erase period (I) of the PDP driving method according to the first exemplary embodiment. In this instance, a problem may occur in which a voltage difference caused by the voltage of Ve is generated between the X and Y electrodes to generate a strong discharge, and the wall charges may be insufficiently erased. That is, as shown in FIG. 7A, when the final sustain discharge pulse of the sustain period is applied, the (−) wall charges are formed on the X electrode, and the (+) wall charges are formed on the Y electrode, and in this instance, a strong discharge can be generated when the Y electrode is biased with the voltage of Ve or Vs and the X electrode is biased with the ground in the erase period (I).

A PDP driving method for solving the above described problem during the erase period will now be described.

Figure 8:
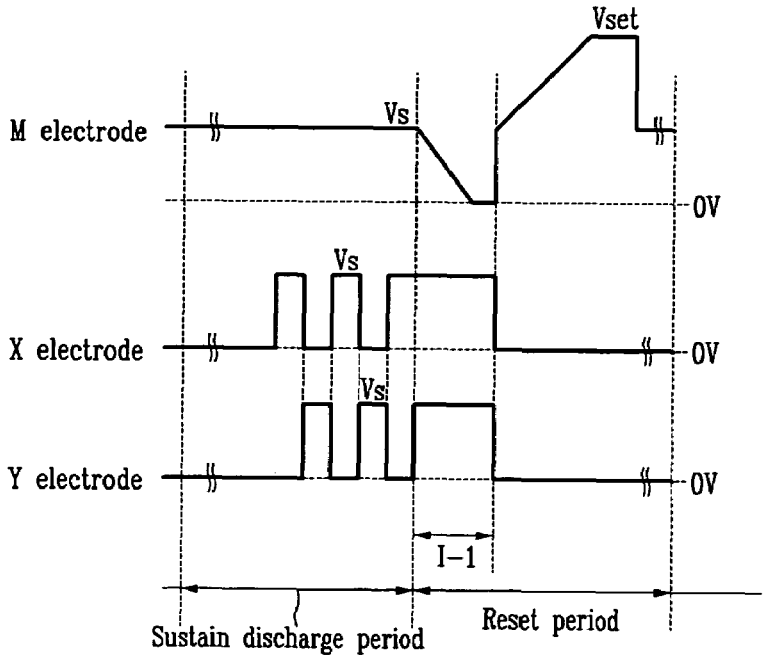
FIG. 8 shows a PDP driving waveform diagram according to a second exemplary embodiment of the present invention.

FIG. 8 shows a PDP driving waveform diagram when another erase waveform is applied according to a second exemplary embodiment of the present invention, wherein a driving waveform of when the final sustain discharge pulse with sustain voltage Vs of the sustain period is applied to the X electrode.

The erase period (I-1) of the reset period will be described in the second exemplary embodiment excluding other repeated portions of the driving method according to the first exemplary embodiment.

As shown in FIG. 8, in the erase period (I-1) of the PDP driving method according to the second exemplary embodiment, a waveform (a ramp waveform or a logarithmic waveform) which gradually falls to the ground voltage from the voltage of Vs is applied to the M electrode while the Y and X electrodes are biased with the voltage of Vs (or Ve). That is, it is controlled to generate no discharge between the Y and X electrodes in the erase period (no discharge is generated between the Y and X electrodes since the voltages applied to the Y and X electrodes have the same voltage level of Vs or Ve), a waveform which gradually falls is applied to the M electrode to generate a weak discharge between the M and Y electrodes, and the wall charges formed during the sustain discharge period are erased. Alternatively, the same purpose can be achieved by applying a small voltage difference (e.g., a first voltage which is slightly less or greater than the voltage of Vs is applied to the Y electrode, and a second voltage which is slightly less or greater than the voltage of Vs is applied to the X electrode) which causes no strong discharge to be generated between the Y and X electrodes in the erase period, that differs from the case of FIG. 8 in which the X and Y electrodes are biased with the same voltage level. In this instance, the small voltage difference (e.g., between the first voltage and the second voltage) can have a range in which the summation of the wall voltage, between the X and Y electrodes, formed in the sustain period, and the voltage difference between the X and Y electrodes in the erase period, does not exceed a firing voltage (or a voltage level where charges discharge from their respective electrodes).

Figure 9:
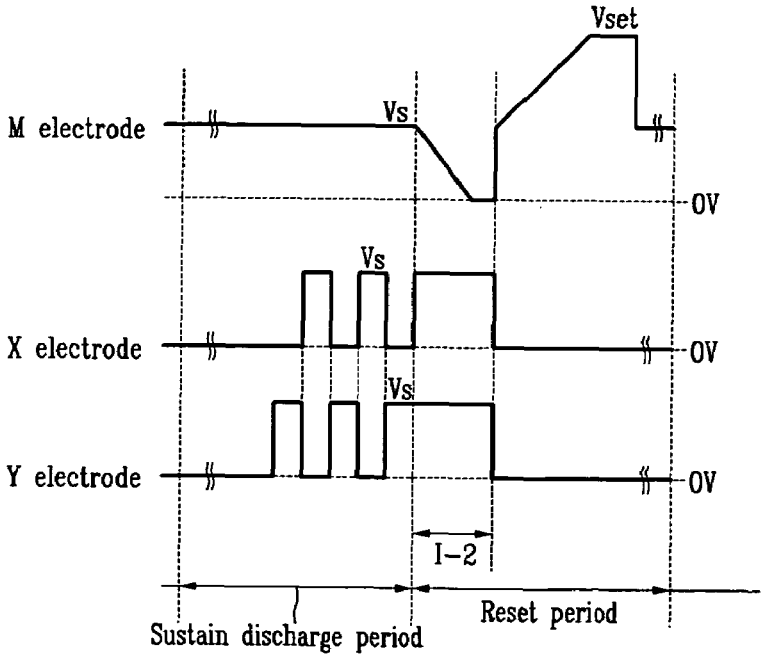
FIG. 9 shows a PDP driving waveform diagram according to a third exemplary embodiment of the present invention.

FIG. 9 shows a PDP driving waveform diagram according to a third exemplary embodiment of the present invention. The driving method according to the third exemplary embodiment corresponds to the driving method according to the second exemplary embodiment except that the final sustain discharge pulse of the sustain discharge period is applied to the Y electrode. That is, a waveform (a ramp waveform or a logarithmic waveform) which gently falls to the ground voltage from the voltage of Vs is applied to the M electrode while the Y and X electrodes are biased with the voltage of Vs (or Ve) in the erase period (I-2). In this case, since the final sustain discharge pulse is applied to the Y electrode and the state of the wall charges (formed on the X and Y electrodes) at the start time of the erase period (I-2) becomes opposite the second exemplary embodiment, weak discharges are generated between the M and X electrodes by applying the gently fallen waveform to the M electrode, and the wall charges formed in the sustain discharge period are erased. The X and Y electrodes have been biased with the same voltage level in FIG. 9, and the same purpose can be achieved by applying a small voltage difference which causes no strong discharge between the Y and X electrodes in the erase period. In this instance, the small voltage difference can have a range such that the summation of the wall voltage between the X and Y electrode formed in the sustain period and the difference of the voltages applied to the X and Y electrodes in the erase period does not exceed a discharge firing voltage.

Figure 10:
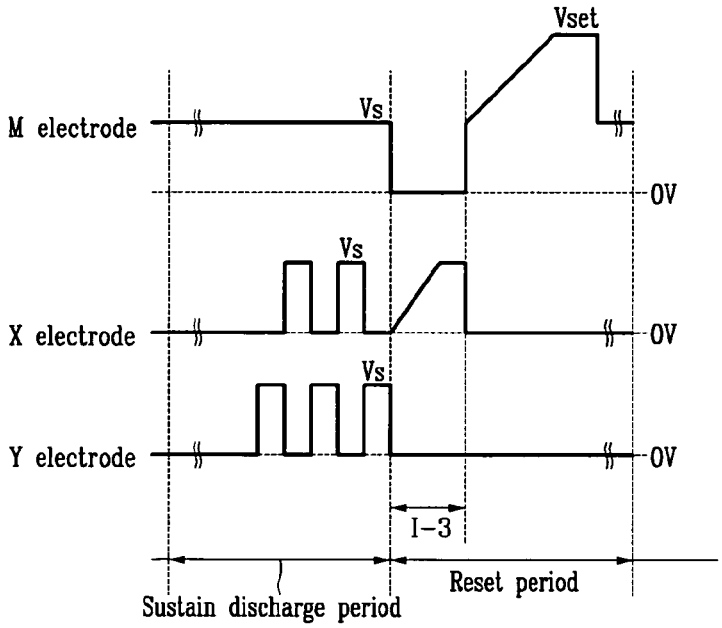
FIG. 10 shows a PDP driving waveform diagram according to a fourth exemplary embodiment of the present invention.

FIG. 10 shows a PDP driving waveform diagram according to a fourth exemplary embodiment of the present invention. In the erase period (I-3) of the driving waveform diagram according to the fourth exemplary embodiment, a gradually rising erase waveform (e.g., from 0V to Vs or Ve) is applied to the X electrode while the M and Y electrodes are biased with the ground, when the final sustain pulse in the sustain discharge period is applied to the Y electrode. The positive wall charges are formed on the X electrode, and the negative wall charges are formed on the Y electrode when the final sustain discharge pulse is applied to the Y electrode, and weak discharges are then generated between the X and M electrodes and between the X and Y electrodes (a weak discharge between the X and M electrode is initially generated, and a weak discharge between the X and Y electrodes is then generated since the distance between the X and Y electrodes is greater than the distance between the X and M electrodes) by applying a gradually rising waveform to the X electrode in the erase period (I-3) to erase the wall charges formed in the sustain discharge period, and in this instance, the M and Y electrodes are biased with the same ground voltage. That is, when the voltage difference between the M and Y electrodes is greater than the discharge firing voltage, a strong discharge can be generated when the wall charges are erased, and hence they are biased with the same voltage level (e.g., the ground voltage.) In this instance, the M and Y electrodes have been biased with the same voltage level in FIG. 10, and the same purpose can be achieved by applying a small voltage difference which causes no strong discharge between the Y and X electrodes in the erase period. In this instance, the small voltage difference can have a range such that the summation of the wall voltage between the M and Y electrode formed in the sustain period and the difference of the voltages applied to the M and Y electrodes (which represents the small voltage difference) in the erase period does not exceed the discharge firing voltage.

Figure 11:
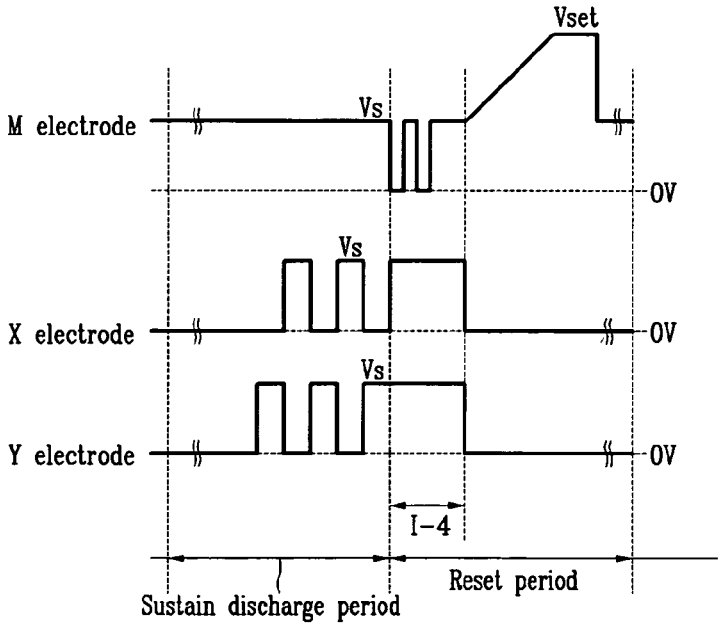
FIG. 11 shows a PDP driving waveform diagram according to a fifth exemplary embodiment of the present invention.

FIG. 11 shows a PDP driving waveform diagram according to a fifth exemplary embodiment of the present invention. As shown, a weak discharge is generated and the wall charges formed in the sustain discharge period are erased by applying narrow pulse waveforms (narrow pulse waveforms at the voltage level as shown in FIG. 11) to the M electrode while the X and Y electrodes are biased with the voltage of Vs (or Ve) in the erase period (I-4). In this instance, the strong discharge which may occur because of the voltage difference between the X and Y electrodes can be prevented by applying the same voltage level of Vs (or Ve) to the X and Y electrodes in the case of erasing the wall charges by applying the narrow pulses to the M electrode. The X and Y electrodes have been biased with the same voltage level in FIG. 11, and the same purpose can be achieved by applying a small voltage difference which causes no strong discharge between the Y and X electrodes in the erase period. In this instance, the small voltage difference can have a range such that the summation of the wall voltage between the X and Y electrode formed in the sustain period and the difference of the voltages applied to the X and Y electrodes in the sustain discharge period may not exceed the discharge firing voltage.

Figure 12:
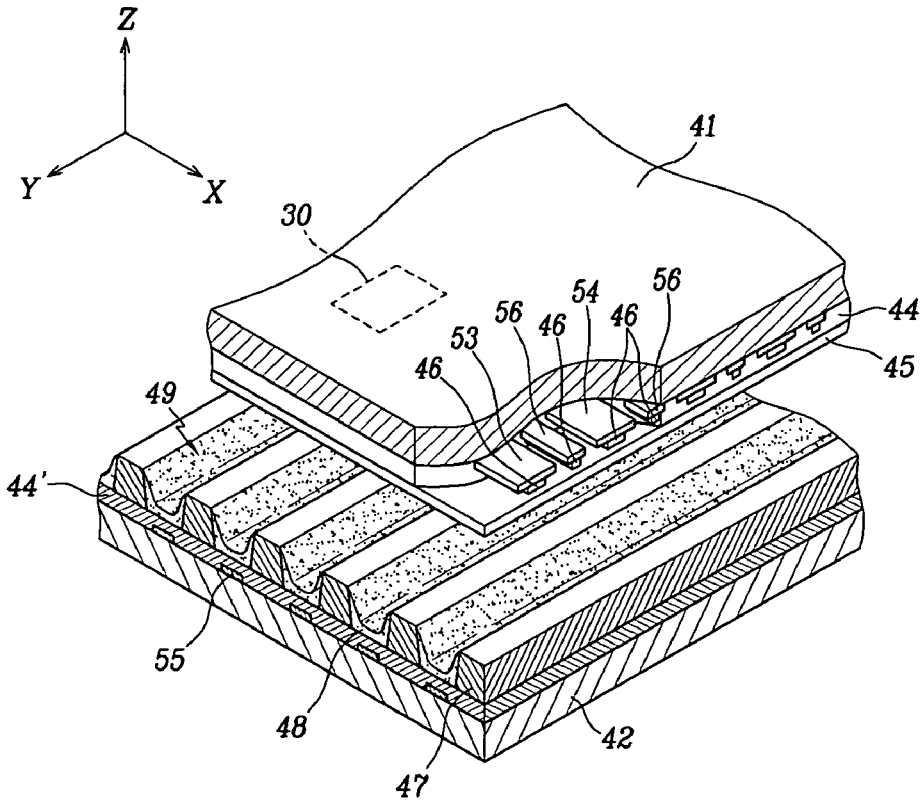
FIGS. 12 and 13 show a perspective view and a cross-sectional view of the PDP according to certain exemplary embodiments of the present invention.
Figure 13:
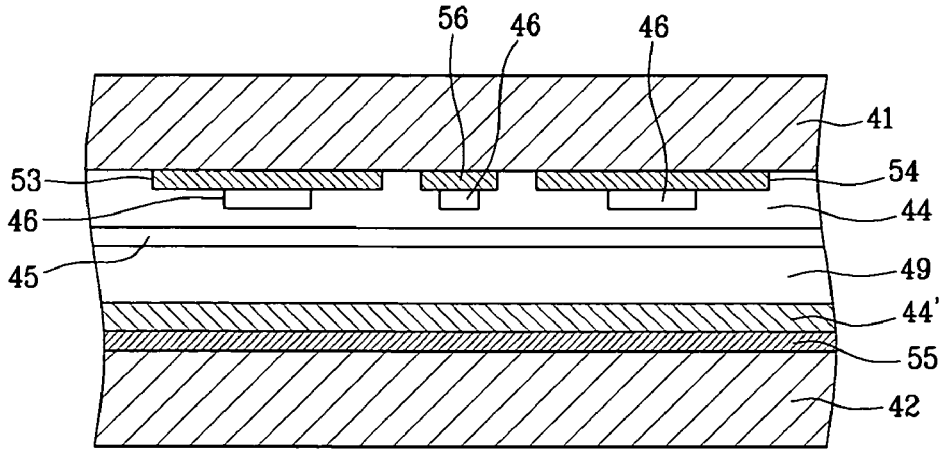

FIGS. 12 and 13 show a perspective view and a cross-sectional view of a PDP according to certain exemplary embodiments of the present invention. The PDP includes first substrate 41 and second substrate 42. X electrode 53 and Y electrode 54 are formed on (or under) first substrate 41. Bus electrodes 46 are formed on the X and Y electrodes 53 and 54, and a dielectric layer 44 and protection film 45 are sequentially formed on X and Y electrodes 54 and 54.

Address electrode 55 is formed on (or over) the surface of second substrate 42, and dielectric layer 44' is formed on address electrode 55. Barrier ribs 47 are formed on dielectric layer 44' and discharge spaces 49 which are formed between barrier ribs 47. Discharge spaces 49 include schematically indicated cell 30 that substantially correspond to discharge cell 30 shown in FIG. 5. Phosphors 48 are applied on the surface of barrier ribs 47 in the cell space of spaces 49 between barrier ribs 47. X and Y electrodes 53 and 54 are formed to be perpendicular to (or cross over) address electrode 55.

In addition, one of middle electrodes 56 is formed between X and Y electrodes 53 and 54 and on (or under) the surface of first substrate 41. As such, a reset waveform and a scan waveform can be applied to the middle electrode, and bus electrodes 46 are formed on the middle electrodes 56.

In view of the foregoing, bad discharges are prevented by forming a middle electrode between X and Y electrodes, applying a reset waveform and a scan waveform to the middle electrode, and applying a sustain discharge voltage waveform to the X and Y electrodes.

Further, since the X and Y electrodes are biased with substantially the same voltage levels in the erase period, the strong discharges which may occur between the X and Y electrodes are prevented, and hence, the wall charges generated during the sustain period are sufficiently erased in the erase period.

While this invention has been described in connection with certain exemplary embodiments, it is to be understood that the invention is not limited to the disclosed exemplary embodiments, but, on the contrary, is intended to cover various modifications included within the spirit and scope of the appended claims, and equivalents thereof.

What is claimed is:

1. A method for driving a plasma display panel in at least a reset period and a sustain period, the plasma display panel comprising a first electrode, a second electrode and a third electrode between the first electrode and the second electrode, the method comprising:

during the sustain period, alternately applying a sustain pulse to the first electrode and the second electrode while maintaining the third electrode at a substantially fixed voltage; and during a period of the reset period, said period being immediately after the sustain period:

(a) applying a positive pulse voltage waveform comprising a first voltage and a second voltage to the third electrode;

(b) applying a third voltage, which is not less than the first voltage and also not less than the second voltage, to the first electrode while the positive pulse voltage waveform is applied;

(c) maintaining the first electrode at the third voltage for a time period longer than a pulse width of the positive pulse voltage waveform;

(d) applying a fourth voltage, which is not less than the first voltage and also not less than the second voltage, to the second electrode while the positive pulse voltage waveform is applied; and (e) maintaining the second electrode at the fourth voltage for a period longer than the pulse width of the positive pulse voltage waveform.

2. The method of claim 1, wherein a voltage level of the third voltage substantially corresponds to that of the fourth voltage.

3. The method of claim 2, wherein voltage levels of the fourth and third voltages correspond to a voltage level of a sustain discharge voltage applied in the sustain period.

* * * * *